US006694953B2

(12) United States Patent
Barnes et al.

(10) Patent No.: US 6,694,953 B2
(45) Date of Patent: Feb. 24, 2004

(54) UTILIZATION OF A RAIL PRESSURE PREDICTOR MODEL IN CONTROLLING A COMMON RAIL FUEL INJECTION SYSTEM

(75) Inventors: Travis E. Barnes, Metamora, IL (US); Michael S. Lukich, Chillicothe, IL (US)

(73) Assignee: Caterpillar Inc, Peoria, IL (US)

( * ) Notice: Subject to any disclaimer, the term of this patent is extended or adjusted under 35 U.S.C. 154(b) by 221 days.

(21) Appl. No.: 10/038,952

(22) Filed: Jan. 2, 2002

(65) Prior Publication Data

US 2003/0121501 A1 Jul. 3, 2003

(51) Int. Cl.[7] ..... F02M 37/04
(52) U.S. Cl. ..... 123/500; 123/456; 123/357
(58) Field of Search ..... 123/446, 456, 123/500, 501, 357; 73/119 A

(56) References Cited

U.S. PATENT DOCUMENTS 4,971,016 A * 11/1990 Peters et al. ..... 123/500
5,191,867 A * 3/1993 Glassey ..... 123/446
5,564,391 A 10/1996 Barnes et al.
5,609,136 A * 3/1997 Tuken ..... 123/357
6,102,018 A * 8/2000 Kerns et al. ..... 123/674
6,138,504 A * 10/2000 Lewis et al. ..... 73/118.2
6,311,669 B1 * 11/2001 Przymusinski et al. ..... 123/300
6,349,702 B1 * 2/2002 Nishiyama ..... 123/456

OTHER PUBLICATIONS

Bernd Mahr, Manfred Dürnholz, Wilhelm Polach, and Hermann Grieshaber, Robert Bosch GmbH, Heavy Duty Diesel Engines—The Potential of Injection Rate Shaping for Optimizing Emissions and Fuel Consumption Stuttgart, Germany, at the 21st International Engine Symposium, May 4–5, 2000, Vienna, Austria.

* cited by examiner

*Primary Examiner*—Carl S. Miller
(74) *Attorney, Agent, or Firm*—Liell & McNeil

(57) ABSTRACT

Although injection timing accuracy is sensitive to rail pressure, injection quantity of the fuel injection event is strongly a function of rail pressure. Thus, delivery accuracy of each injection event depends strongly upon the accuracy of a rail pressure estimate used in determining the injection control signal characteristics. These injection control signal characteristics include a calculated delay between a start of control current and start of injection, as well as the duration of the control signal. The present invention takes a rail pressure measurement substantially before an injection event, and then utilizes a rail pressure predictor model to predict what the rail pressure will be at each injection event in a succeeding injection sequence. This estimated rail pressure is then used as the means for determining the fuel injection control signal characteristics for that succeeding injection event.

20 Claims, 3 Drawing Sheets

UTILIZATION OF A RAIL PRESSURE PREDICTOR MODEL IN CONTROLLING A COMMON RAIL FUEL INJECTION SYSTEM

TECHNICAL FIELD

The present invention relates generally to electronically controlled common rail fuel injection systems, and more particularly to the utilization of a rail pressure predictor model to improve accuracy of fuel injection in a common rail fuel injection system.

BACKGROUND

Common rail fuel injection systems come in many forms. For instance, a common rail fuel injection system might maintain fuel at injection pressure levels in the common rail, and then inject at that pressure by respective fuel injectors connected to the common rail. In another example, a separate actuation fluid, such as lubricating oil, is maintained in a common rail at a medium pressure level. This actuating fluid is then supplied to individual injectors which utilize the actuation fluid to hydraulically pressurize fuel within the individual injectors to injection pressure levels. In still another example, fuel is maintained in a common rail at a medium pressure level. The individual fuel injectors connected to such a rail have the ability to inject directly at the medium pressure level, or utilize the medium pressure fuel to hydraulically intensify the pressure of the fuel to be injected from the fuel injector. In all of these cases, the fuel injection rate is strongly a function of the rail pressure. Thus, as one would expect, the determination of injection control signals are currently based at least in part upon an estimated rail pressure. Thus, the accuracy of any given fuel injection event is strongly related to the accuracy of a rail pressure estimate used in determining the injection control signals that will be used in an attempt to deliver those desired injection characteristics.

Engineers have observed that rail pressure can vary substantially between injection sequences but also within an injection sequence itself. In many cases, these fluctuations in rail pressure can exceed 15% of the average rail pressure especially, and possibly to a larger extent, during cold starting. These fluctuations in rail pressure can be attributable to a number of phenomena. For instance, localized rail pressure fluctuations can be attributable to pressure waves bouncing around in the common rail due to such events as the opening and closing of various valves. More significantly, however, is the fact that in most cases the common rail is steadily supplied with fluid from a high pressure pump, but fluid is consumed from the rail by the injectors in brief gulps. Thus, one could expect rail pressure to drop with each injection event, and then recover between events. In an injection sequence that includes more than one injection event (e.g., pilot and main) it is probable that each injection event in the sequence could start at a different rail pressure. Thus, much more accurate delivery timings and quantities can be achieved if the rail pressure is known at the start of each injection event. Unfortunately, it is currently difficult to instantaneously obtain an accurate rail pressure measurement, and in the same instant, generate control signals based upon that rail pressure measurement, and again in that same instant carry out the determined control signal. Thus, one problem associated with improving delivery and timing accuracy of fuel injection events is the problem of accurately determining what the rail pressure will be at the beginning of each one of those events.

The present invention is directed to these and other problems associated with controlling common rail fuel injection systems.

SUMMARY OF THE INVENTION

In one aspect, a method of improving accuracy of fuel injection includes an initial step of determining injection characteristics for an injection sequence that includes at least one injection event and measuring the rail pressure prior to a start of the injection sequence. The rail pressure at a timing associated with each injection event of the injection sequence is estimated based at least in part on a rail pressure predictor model that includes the measured rail pressure. Control signal characteristics for the injection sequence are determined based at least in part on the estimated rail pressure and the injection characteristics.

In another aspect, a common rail fuel injection system includes a common rail with an inlet connected to a supply pump and at least one outlet connected to a plurality of fuel injectors. An electronic control module is operably coupled to the plurality of fuel injectors and includes a rail pressure predictor model.

In still another aspect, a rail pressure predictor model for predicting rail pressure in a common rail fuel injection system is recorded on a computer readable storage medium. In addition, an injector control signal determination algorithm for determining control signal characteristics based at least in part on a predicted rail pressure is also recorded on the computer readable data storage medium.

DETAILED DESCRIPTION

Figure 1:
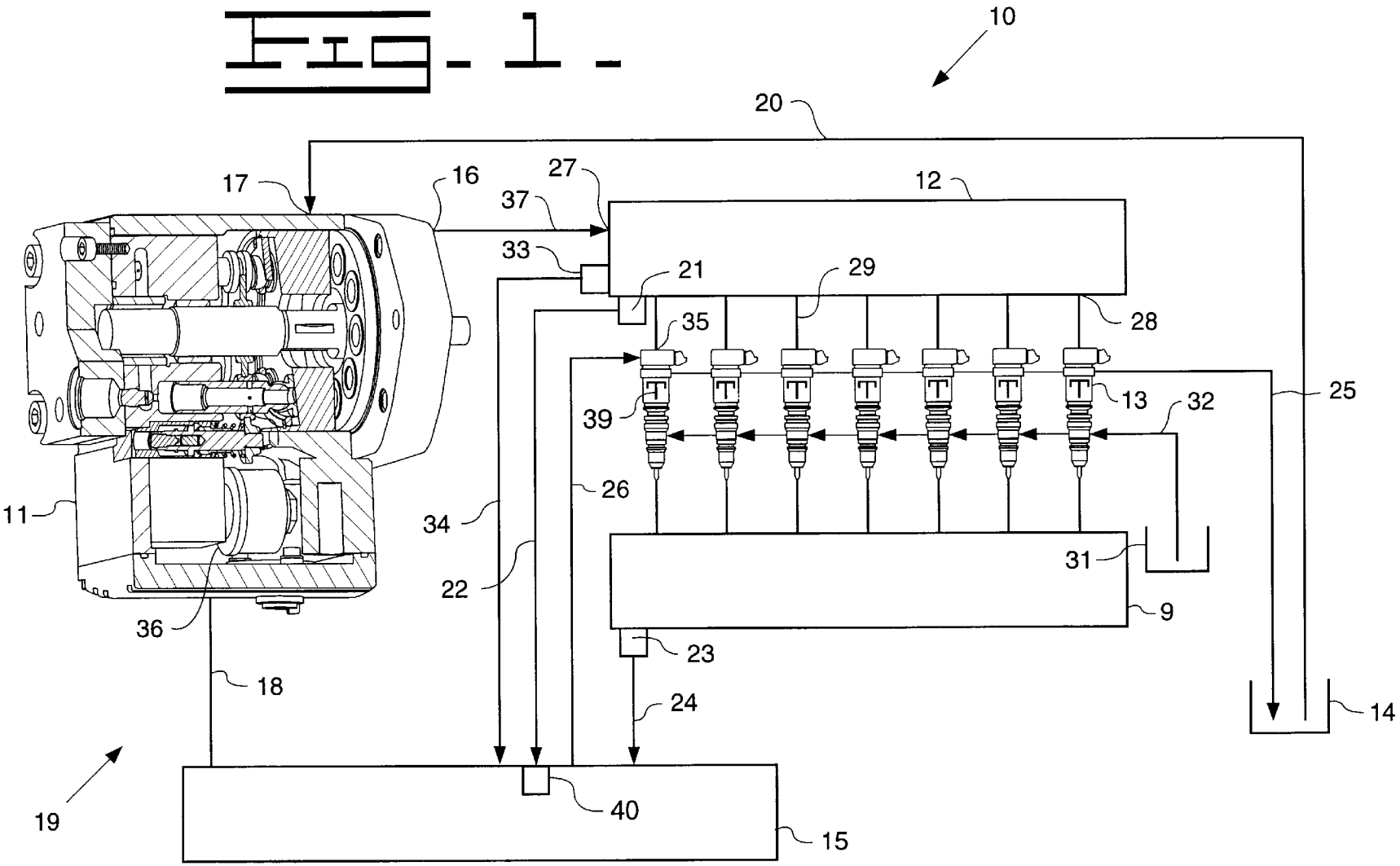
FIG. 1 is a schematic illustration of an engine and a common rail fuel injection system according to an embodiment of the present invention.

Referring to FIG. 1, an internal combustion engine 9, which is preferably a compression ignition engine, includes a common rail fuel injection system 10 that includes a pump 11, a high pressure common rail 12 and a plurality of fuel injectors 13. Pump 11 can be any suitable high pressure pump, but is preferably a fixed displacement sleeve metered variable delivery axial piston pump of the type generally described in co-owned U.S. Pat. No. 6,035,828. Those skilled in the art will appreciate that any suitable pump, such as a variable angle swash plate pump whose output is controlled via an electrical signal, could be substituted for the illustrated pump without departing from the intended scope of the present invention. In addition, fixed delivery pumps could also be utilized with the inclusion of some means to control rail pressure. For instance, in some previous common rail fuel injection systems, a fixed delivery pump is used and a separate rail pressure control valve is utilized to control rail pressure by leaking a portion of the pressurized fluid in the common rail back to drain. In the illustrated example, the common rail contains an amount of pressurized actuating fluid, which is preferably engine lubricating oil, but could be any other suitable fluid, such as fuel.

Fuel injectors 13 are preferably hydraulically actuated fuel injectors of the type manufactured by Caterpillar, Inc. of Peoria, Ill., but could be any suitable common rail type fuel injector, including but not limited to pump and line common rail fuel injectors, or possibly a Bosch type common rail fuel injector of the type described in "Heavy Duty Diesel Engines—The Potential of Injection Rate Shaping for Optimizing Emissions and Fuel Consumption", presented by Messrs Bernd Mahr, Manfred Dürnholz, Wilhelm Polach, and Hermann Grieshaber, Robert Bosch GmbH, Stuttgart, Germany at the 21st International Engine Symposium, May 4–5, 2000, Vienna, Austria. Thus, those skilled in the art will appreciate that, depending upon the structure of the common rail fuel injection system, an other fluid, such as diesel fuel (Bosch) could be used in the common rail without departing from the intended scope of the present invention.

In the preferred embodiment illustrated, variable delivery pump 11 includes an inlet 17 connected to a low pressure reservoir/oil pan 14 via a low pressure supply line 20. An outlet 16 of variable delivery pump 11 is fluidly connected to an inlet 27 of high pressure common rail 12 via a high pressure supply line 37. Common rail 12 includes a plurality of outlets 28 that are fluidly connected to fuel injector inlets 35 via a plurality of high pressure supply lines 29. After being used by the respective fuel injectors 13, the used oil returns to low pressure reservoir 14 via an oil return line 25 for recirculation. The system also includes, in this example embodiment, a fuel tank 31 that is fluidly connected to fuel injectors 13 via a fuel supply line 32, which is preferably at a relatively low pressure relative to that in high pressure common rail 12.

In order to control fuel injection system 10 and the operation of engine 9, an electronic control module 15 receives various sensor inputs, and uses those sensor inputs and other data to generate control signals. These control signals are usually in the form of a control current level, or control signal duration and timing, to control the various devices, including the variable delivery pump 11 and the fuel injectors 13. In particular, a pressure sensor 21 senses pressure somewhere in the common rail 12 and communicates a pressure signal to control module 15 via a sensor communication line 22 and a sensor filter 40, which could be a portion of the electronic control module 15. The electronic control module 15, uses the pressure sensor signal to estimate the pressure in the common rail 12. A speed sensor 23 which is suitably located on engine 9, communicates a sensed speed signal to electronic control module 15 via a sensor communication line 24. A temperature sensor 33, which can be located at any suitable location in common rail fuel injection system 10 but is preferably located in rail 12, communicates an oil temperature sensor signal to electronic control module 15 via a sensor communication line 34. Like the other sensors, electronic control module 15 uses the signal to estimate the oil temperature in fuel injection system 10. The electronic control module preferably combines the temperature estimate with other data, such as an estimate of the grade of the oil in system 10, to generate a viscosity estimate for the oil. Those skilled in the art will appreciate that viscosity estimates can be gained by other means, such as by pressure drop sensors, viscosity sensors, etc. In other common rail systems, viscosity is less of a concern. Electronic control module 15 controls the activity of fuel injectors 13 in a conventional manner via an electronic control signal communicated via injector control lines 26, only one of which is shown. A typical control signal for an injection event is characterized by the timing at which the control signal is initiated and the duration of that signal. Nevertheless, the present invention is not limited to those systems in which fuel injection quantity is a function of the control signal duration. Thus, in most instances, the electronic control module determines and controls current levels, durations and timings.

Electronic control module 15 also controls a pump output controller 19 that includes an electro hydraulic actuator 36 and a control communication line 18. Preferably, electro hydraulic actuator 36 controls the output of variable delivery pump 11 in proportion to an electric current supplied via control communication line 18 in a conventional manner. For instance, in the preferred embodiment, electro hydraulic actuator 36 moves sleeves surrounding pistons in pump 11 to cover spill ports to adjust the effective stroke of the pump pistons, and hence the output from the pump. The pump output controller 19 could be analog, but preferably includes a digital control strategy that updates all values in the system at a suitable rate, such as so many milliseconds. The pump control signal generated by electronic control module 15 is preferably a function of the desired rail pressure, the estimated rail pressure and the estimated consumption rate of the entire fuel injection system 10.

At regular intervals, the electronic control module 15 determines a set of desired injection characteristics for a succeeding injection sequence. Each injection sequence includes one or more injection events, and the electronic control module determines a desired timing for each injection event and a desired quantity of fuel to inject in each injection event. The desired injection sequence characteristics are preferably determined after a previous injection event but before a succeeding injection sequence. Also, at some time between the preceding injection event and a succeeding injection event, a rail pressure measurement is taken via rail pressure sensor 21. The control signal characteristics to be determined include a timing delay between the start of current and the start of injection, and a control signal duration. These delay and duration variables are determined in a conventional manner, such as by utilizing equations and/or look up tables. In the case of the illustrated fuel injection system 10, the timing delay is preferably calculated using rail pressure and temperature as independent variables. The duration signal is preferably calculated using a lookup table that uses rail pressure and desired fuel injection quantity as independent variables. Thus, in order to produce the desired injection event at the desired timing, current to the individual injector is initiated at a timing that corresponds to the desired injection event timing as advanced by the determined delay. And the control signal continues for the determined duration in order to cause the injector to inject fuel in a manner that corresponds to the desired injection event. It is simply not practical to measure the rail pressure at the start of current and then do the necessary lookups regarding duration. It is not possible to measure the rail pressure at start of current and use it to determine the delay between start of current and start of injection. A more practical option is to measure the pressure after the previous cylinder events are complete, but before setting up the first injection event on the current cylinder. The measured pressure can then be used as an initial condition in a rail pressure predictor model to estimate the rail pressure for each of the succeeding injection events that occur in that cylinder.

The rail pressure predictor model according to one embodiment of the present invention preferably takes into account the bulk modulus of the fluid in the common rail in combination with the expected oil flow balance during and preceding the injection event(s). The average oil flow has to be balanced between the pump and the injector to maintain an average desired rail pressure. The pump will supply oil in a relatively steady manner, but the injectors use the oil in gulps, so the pressure will drop with each injection event, and then will recover between the events. Although the rail pressure predictor model can be as sophisticated as desired, in the preferred model the rail pressure at any given crank angle data can be estimated from the following equation:

$$P_\theta = P_O + Q_P * K_P * \theta - \Sigma(Q_{inj}) * K_{inj}$$

Where:

$P_\theta$—Pressure at a crank position $P_O$—Initial pressure measured just before all the setup calculations $Q_P$—Pump flow rate (cc/rev). This is preferably a function of pump current.

$K_P$—Pump flow pressure constant $\theta$—Crank degrees from the sample location for $P_O$ to the event location $\Sigma(Q_{inj})$—The sum of all oil consumed for all injection events between the initial rail pressure sample and the current location. This is preferably determined from an injector oil consumption model.

$K_{inj}$—Injector flow pressure constant

The equation can be used to estimate the rail pressure at the start of each injection event. The estimated pressure can then be used for the delay and duration lookups in determining the injection control signal characteristics. The pump flow will preferably be a two dimensional map that is a function of the commanded current to the high pressure pump. The injector oil consumption estimate can also be as sophisticated as desired. For instance, oil consumption could simply be a two dimensional map using desired fuel injection quantity as the independent variable. In a more sophisticated model, the injector oil consumption estimate could also include a factor based upon the number of injection events that preceed the calculated injection event. In other words, each injector consumes a predetermined amount of oil when activated before any fuel is actually injected from the injector. For instance, this factor may account for a poppet valve that briefly opens the high pressure rail to drain when moving from one position to another in initiating an injection event.

An improvement over just running the model open loop would be to measure the pressure to set the initial conditions, then measure the pressure at the end of the injection events. By comparing the pressure at the end of the injection events with an estimated pressure at the end of the injection events, the model can be adaptive through a closed loop controller. In such a case, the $K_{inj}$ term will be modified by a $K_{adapt}$ term based on the error between the estimated and the measured rail pressure values. The equation would be as follows:

$$K_{inj} = K_{inj\text{-}nominal} + K_{adapt}$$

Figure 5:
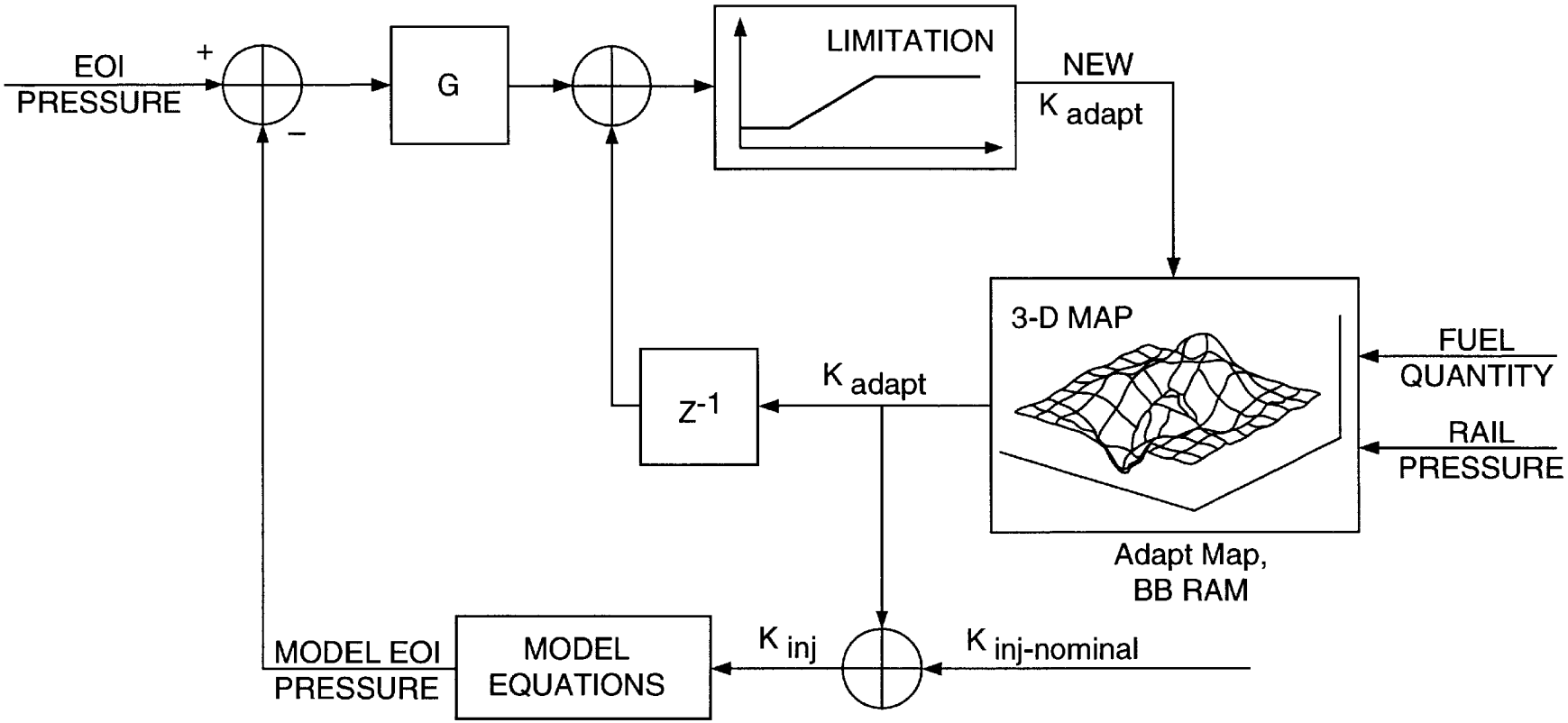
FIG. 5 is an example closed loop control diagram for updating a rail pressure predictor model based upon actual rail pressure measurements.

The $K_{adapt}$ term could be stored in battery backed RAM, and is preferably mapped as a function of rail pressure and total fuel quantity to provide adaptation over the entire operating range of the injector. In other words, $K_{adapt}$ would be different depending upon the operating condition of the engine as expressed via rail pressure and desired injection quantity. Preferably, the adaptive control should not be updated when the engine is cold or rail pressure fault modes are present. One example methodology for implementing such a closed loop strategy for updating the rail pressure predictor model based upon a comparison of estimated rail pressure to measured rail pressure is shown in FIG. 5.

Those skilled in the art will appreciate that, not only should the rail pressure measurement be accurate, but also the time corresponding to that measurement be known accurately. Any hardware filters in the sensor circuit will inevitably cause an error in the actual rail pressure measurement. Filters tend to reduce the magnitude of the rail pressure peak amplitude and tend to introduce a phase lag between the actual rail pressure values and the measured rail pressure values. Thus, any hardware filters should be selected to minimize the affect on the rail pressure reading, or some strategy should be developed to correct for the effect of the filter on the measured value. One potential solution might be to employ hardware filters having relatively high frequencies, such as 500 Hz, so that the distortion effects on the rail pressure reading are reduced to better levels.

Industrial Applicability

Figures 2, 3, 4:
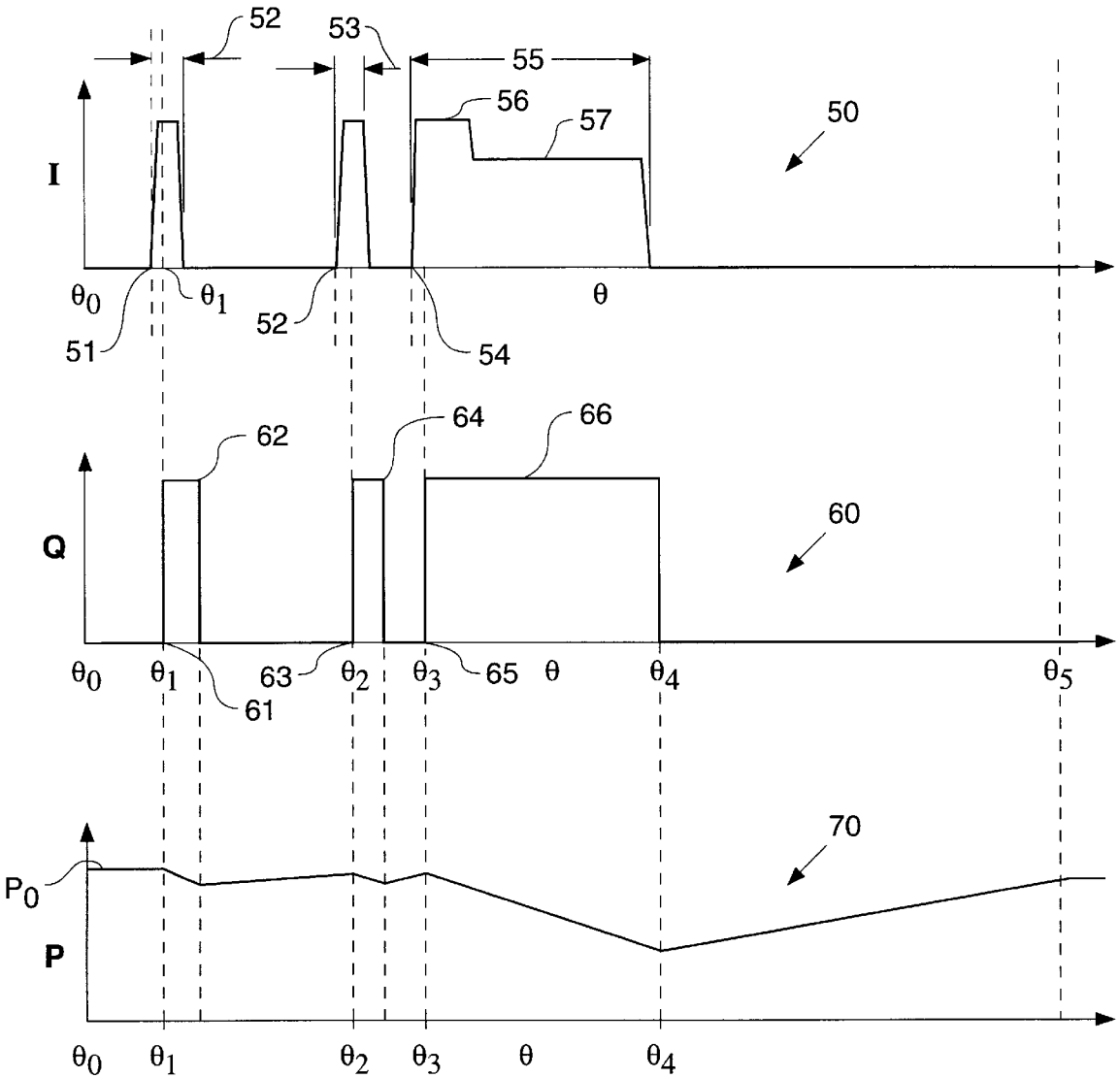
FIG. 2 is a graph of control signal verses crank angle for an example injection sequence.
FIG. 3 is a graph of fuel injection rate verses engine crank angle produced by the control signal sequence of FIG. 2.
FIG. 4 is a graph of rail pressure verses engine crank angle for the injection sequence of FIG. 3.

Referring now to FIGS. 2–4, control current level "I", injection fuel rate "Q", and rail pressure "P" are graphed against engine crank angle $\theta$ for a single injection sequence 60. The injection sequence includes an early pilot injection 62, a close pilot injection 64 and a main injection 66. The early injection event 62 has a start of injection timing 61 at $\theta_1$, close pilot injection event 64 has a start of injection timing 63 at $\theta_2$ and main injection event 66 has a start of injection timing 65 at $\theta_3$. $\theta_4$ corresponds to the end of the injection event. $\theta_5$ corresponds to the end of the injection sequence for that individual cylinder. Thus, FIG. 3 shows what the electronic control module has determined to be the desired injection characteristics for the succeeding injection events. The pressure measurement $P_0$ is taken at crank angle $\theta_0$. This event can be triggered in any suitable manner, and preferably occurs between rail pressure recovery events, or at a determinable location on a rail pressure model curve.

The next step in the process will be to estimate what the rail pressure will be at $\theta_1$, $\theta_2$ and $\theta_3$, which correspond to the start of injections for each of the three injection events in the injection sequence. Using the rail pressure modeling equation, the rail pressure at $\theta_1$ can be expressed as follows:

$$P_{\theta^1} = P_0 + Q_P * K_p * (\theta_1 - \theta_0)$$

With that estimated rail pressure, the start of current/start of injection timing delay can be calculated in a conventional manner, such as by using a lookup table of rail pressure and oil temperature. Next, the duration of the early pilot injection event is determined using a three dimensional lookup table having rail pressure and desired quantity as independent variables. The rail pressure at $\theta_2$ can be estimated using the same rail pressure predictor model equation and is expressed as follows:

$$P_{\theta^2} = P_0 + Q_P . K_p (\theta_2 - \theta_0) - Q_1 * K_{inj}$$

likewise, the estimated rail pressure at $\theta_3$ can be expressed as follows:

$$P_{\theta^3} = P_0 + Q_p * K_p (\theta_3 - \theta_0) - (Q_1 + Q_2) * K_{inj}$$

These estimated pressures are used in the necessary lookups to determine the injection characteristics for the close pilot and main injection events. In particular, the start of currents 51, 52 and 54 for the control sequence are determined in a conventional manner. Likewise, control current durations 52, 53 and 55 are determined in a similar manner. The current drop from pull-in current 56 to hold-in current 57 reflects a drop in energy necessary to maintain a valve in an open position.

Referring now in addition to FIG. 5, an example closed loop system for updating and adapting the rail pressure predictor model across the engines operating range is shown. The first step in this procedure is to predict what the rail pressure will be on the rail pressure predictor curve 70 at timing $\theta_4$, which corresponds to the end of main injection event 66. The electronic control module has been programmed to take a rail pressure measurement at timing $\theta_4$. The estimated end of injection (EOI) pressure is subtracted from the predicted end of injection pressure, and the error is multiplied by a gain G. The error multiplied by the gain G is added to the previous $K_{adapt}$ and then filtered and limited. Filtering and applying appropriate limitations avoids updating the $K_{adapt}$ map with bad data. After proceeding through the limitator, the $K_{adapt}$ term is stored in battery backed RAM in an appropriate location, such as a three dimensional map using fuel quantity and rail pressure. Although it may be more desirable to map against fuel quantity and engine speed or rail pressure and engine speed. Further development may be required to determine the best axis for the map. That $K_{adapt}$ term is added to the fixed $K_{inj\text{-}nominal}$ term to produce the $K_{inj}$ that is used in the rail pressure predictor model equations identified above. In this way, the rail pressure predictor model can customize itself to an individual engine's performance across its operating range.

The timing $\theta_0$ at which the initializing rail pressure measurement is taken preferably occurs between rail pressure recovery events. In other words, that initializing pressure measurement is preferably taken between the effects of injection events when the rail pressure is relatively stabilized. Alternatively, the rail pressure measurement could be taken at any suitable location on any determinable location on a rail pressure predictor curve, such as curve 70 shown in FIG. 4. For instance, one could use the measured pressure at the end of the previous injection $\theta_4$, modifying the model equations accordingly, and predict the respective rail pressure at the timings corresponding next succeeding injection sequence. Those skilled in the art will recognize that the example rail pressure model disclosed does not appear to take into account the possibility of overlapping injection events used in different cylinders. Nevertheless, the present invention contemplates a more sophisticated model could be developed to predict rail pressure even in the case of overlapping injection events in different cylinders drawing fluid from the same common rail. In addition, the model could also be adapted to take into account other devices, such as hydraulic valve actuators, that may also use fluid from the same rail. Although the example illustrated shows that the rail pressure measurement is used to estimate rail pressure for the next injection event, present invention also contemplates the likelihood that a model could be sufficiently accurate to also estimate pressure for two succeeding injection sequences if desired, or possibly if needed because of a lack of processor time available for taking new rail pressure measurements under certain conditions.

Although the example embodiment shows that it is preferred to estimate rail pressure at the start of each intended injection event timing, this merely reflects the fact that, in the illustrated embodiment, the timing offset and injection quantity maps were generated as a function of rail pressure at the beginning of the injection event. Thus, the present invention could be further improved by insuring that the timing offset and injection quantity maps are generated in a manner that assumes rail pressure drops as predicted in the rail pressure predictor model curve 70. Alternatively, the rail pressure might be predicted at some other timing associated with the individual injection event, such as at a mid point if that were more appropriate for the control signal characteristic calculation strategy.

Those skilled in the art will appreciate that various modifications could be made to the illustrated embodiment without departing from the intended scope of the present invention. Although the present invention has been illustrated in the context of a hydraulically actuated fuel injector that includes a pressure intensifier 39, the present invention could be applicable to any common rail fuel injection system in which fuel injection timing and/or fuel injection quantity are a function of rail pressure. Thus, those skilled in the art will appreciate the other aspects, objects and advantages of this invention can be obtained from a study of the drawings, the disclosure and the appended claims.

What is claimed is:

1. A method of improving accuracy of fuel injection, comprising the steps of:

determining injection characteristics for an injection sequence that includes at least one injection event;

measuring a rail pressure previous to a start of the injection sequence;

estimating a rail pressure at a timing associated with each injection event of the injection sequence based at least in part on a rail pressure predictor model that includes the measured rail pressure; and determining injector control signal characteristics for the injection sequence based at least in part on the estimated rail pressure and the injection characteristics.

2. The method of claim 1 wherein said measuring step is performed at least one of, between rail pressure recovery events, and a determinable location on a rail pressure curve.

3. The method of claim 1 wherein the injection sequence includes a plurality of injection events.

4. A method of improving accuracy of fuel injection, comprising the steps of:

determining injection characteristics for an injection sequence that includes at least one injection event;

measuring a rail pressure previous to a start of the injection sequence;

estimating a rail pressure at a timing associated with each injection event of the injection sequence based at least in part on a rail pressure predictor model that includes the measured rail pressure;

determining control signal characteristics for the injection sequence based at least in part on the estimated rail pressure and the injection characteristics;

wherein said estimating step includes the steps of:

estimating a rail pressure increase between a timing associated with the rail pressure measurement and the timing associated with each injection event of the injection sequence;

estimating a rail pressure drop between a timing associated with the rail pressure measurement and the timing associated with each injection event of the injection sequence;

adding the measured rail pressure to the estimated rail pressure increase and the estimated rail pressure drop for each injection event.

5. The method of claim 4 wherein said step of estimating a rail pressure increase includes a step of estimating a rail pressure supply pump output rate.

6. The method of claim 4 wherein said step of estimating a rail pressure drop includes a step of estimating an amount of fluid that will leave the rail before the timing associated with each injection event.

7. The method of claim 1 including the steps of:

predicting a rail pressure at a predetermined timing;

measuring rail pressure at the predetermined timing;

adjusting the rail pressure predictor model based at least in part on a comparison of the predicted rail pressure and the measured rail pressure from the predetermined timing.

8. The method of claim 1 wherein said measuring step is performed at one of between rail pressure recovery events and a predetermined location on a predictable rail pressure curve;

said estimating step includes the steps of estimating a rail pressure supply pump output rate and estimating an amount of fluid that will leave the rail before the timing associated with each injection event;

predicting a rail pressure at a predetermined timing;

measuring rail pressure at the predetermined timing;

adjusting the rail pressure predictor model based at least in part on a comparison of the predicted rail pressure and the measured rail pressure from the predetermined timing.

9. A common rail fuel injection system comprising;

a common rail containing a pressurized fluid;

a supply pump with an outlet fluidly connected to said common rail;

a plurality of fuel injectors with inlets fluidly connected to said common rail;

an electronic control module operably coupled to said plurality of fuel injectors and including a rail pressure predictor model and an injector control signal determinator based at least in part on said rail pressure predictor model.

10. The fuel injection system of claim 9 wherein each of said fuel injectors includes a hydraulically driven pressure intensifier.

11. The fuel injection system of claim 9 including a rail pressure sensor in communication with said electronic control module; and a pump output controller attached to said supply pump and being in communication with said electronic control module.

12. A common rail fuel injection system comprising;

a common rail containing a pressurized fluid;

a supply pump with an outlet fluidly connected to said common rail;

a plurality of fuel injectors with inlets fluidly connected to said common rail;

an electronic control module operably coupled to said plurality of fuel injectors and including a rail pressure predictor model that includes a pressure increase predictor and a pressure decrease predictor.

13. The fuel injection system of claim 12 wherein said pressure increase predictor includes a pump output rate estimator.

14. The fuel injection system of claim 12 wherein said pressure decrease predictor includes an injector fluid consumption estimator.

15. The fuel injection system of claim 9 wherein said rail pressure predictor model includes an adaptive variable that is based at least in part on a comparison of a predicted variable to a measured variable.

16. The fuel injection system of claim 9 having a predetermined maximum injection frequency in association with an engine; and a hardware filter operably positioned between said electronic control module and a rail pressure sensor, and being operable at a frequency that is greater than said maximum injection frequency.

17. The fuel injection system of claim 16 wherein each of said fuel injectors includes a hydraulically driven pressure intensifier;

a rail pressure sensor in communication with said electronic control module;

a pump output controller attached to said supply pump and being in communication with said electronic control module; and said rail pressure predictor model includes a pressure increase predictor, a pressure decrease predictor, and an adaptive variable that is based at least in part on a comparison of a predicted variable to a measured variable.

18. An article comprising:

a computer readable data storage medium;

a rail pressure predictor model recorded on the medium for predicting rail pressure in a common rail fuel injection system; and an injector control signal determination algorithm recorded on the medium for determining injector control signal characteristics based at least in part on a predicted rail pressure.

19. The article of claim 18 including a rail pressure reader algorithm recorded on the medium for reading a rail pressure measurement at a timing that is at least one of, between rail pressure recovery events and at a determinable location on a rail pressure curve.

20. The article of claim 19 including a predictor model adaptation algorithm recorded on the medium for adapting the rail pressure predictor model based at least in part on a comparison of a predicted variable to a measured variable.

* * * * *